US006907822B2

(12) United States Patent
Coningsby

(10) Patent No.: US 6,907,822 B2
(45) **Date of Patent: *Jun. 21, 2005**

(54) DRY OFFSET ROTARY PRINTER FOR LABELING WINE CORKS

(75) Inventor: Gregg O. Coningsby, Ft. Lauderdale, FL (US)

(73) Assignee: Apex Machine Company, Ft. Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/375,873

(22) Filed: Feb. 26, 2003

(65) Prior Publication Data

US 2003/0127000 A1 Jul. 10, 2003

Related U.S. Application Data

(63) Continuation of application No. 09/776,376, filed on Feb. 2, 2001, now Pat. No. 6,526,880, which is a continuation of application No. 09/411,823, filed on Oct. 1, 1999, now Pat. No. 6,220,154.

(51) Int. Cl.[7] ..... B41F 17/14; B41F 17/20; B41F 17/22

(52) U.S. Cl. ..... 101/40.1; 101/38.1

(58) Field of Search ..... 101/38.1, 40.1, 101/35, 36, 37, DIG. 39

(56) References Cited

U.S. PATENT DOCUMENTS

| | | | | |
|---|---|---|---|---|
| 1,460,650 A | * | 7/1923 | Gillespie et al. | 209/545 |
| 1,835,334 A | * | 12/1931 | Risser | 53/304 |
| 4,081,720 A | | 3/1978 | Pfefferkorn et al. | |
| 4,342,281 A | * | 8/1982 | McMillin et al. | 118/32 |
| 4,398,627 A | | 8/1983 | Saccani | |
| 4,812,317 A | | 3/1989 | Taylor | |
| 5,480,915 A | | 1/1996 | Burns | |
| 5,496,862 A | | 3/1996 | Burns | |
| 5,641,573 A | * | 6/1997 | Collins | 428/409 |
| 5,692,629 A | | 12/1997 | Burns | |
| 5,710,184 A | | 1/1998 | Burns | |
| 5,855,287 A | | 1/1999 | Burns | |
| 5,904,965 A | | 5/1999 | Noel et al. | |
| 6,220,154 B1 | * | 4/2001 | Coningsby | 101/38.1 |
| 6,280,801 B1 | | 8/2001 | Schmitt | |
| 6,526,880 B2 | * | 3/2003 | Coningsby | 101/40.1 |

FOREIGN PATENT DOCUMENTS

| | | |
|---|---|---|
| FR | 2312373 | 12/1976 |
| GB | 813024 | 5/1959 |

OTHER PUBLICATIONS

Deposition of Todd Coningsby, Aug. 28, 2003, pp. 265–299, vol. 3 of 3.

(Continued)

*Primary Examiner*—Daniel J. Colilla
(74) *Attorney, Agent, or Firm*—Adams Evans P.A.

(57) ABSTRACT

A rotary printing machine for the printing of synthetic cork stoppers of the type having a surface which is normally non-ink receptive. A Ferris wheel mechanism is provided, having a plurality of evenly spaced carriers mounted a predetermined radial distance from and parallel to the axis of rotation for the Ferris wheel mechanism, each carrier for rotatably holding a synthetic cork stopper. An indexing drive system controls incremental rotation of the Ferris wheel mechanism through a predetermined sequence of steps, and a cork feeder introduces a single synthetic cork stopper into each of the carriers as empty ones of the carriers are presented one-by-one at the cork feeder. A corona discharger treats the surface of each synthetic cork stopper prior to being printed with sufficient energy to alter the surface energy of the cork sufficiently to permit receptivity of printing ink. A rotary printing system rotatably imprints with ink the surface of each held synthetic cork stopper with an image.

13 Claims, 8 Drawing Sheets

OTHER PUBLICATIONS

Apex Machine Company Cork Printer Sales List, Exhibit 63 to Deposition of Todd Coningsby, 1 pg.
Exhibit 65 to Deposition of Todd Coningsby, Exhibit "A", 1 pg.
Davell, William, Exhibit 66 to Deposition of Todd Coningsby, Plaintiff's Motion & Supporting Memorandum for Leaving to Amend Complaint, Aug. 11, 2003, 21 pgs.
Scioratto, Luigi, Exhibit 67 to Deposition of Todd Coningsby, Letter, Jun. 16, 2000, 1 pg.
Apex Machine Company, Exhibit 68 to Deposition of Todd Coningsby, Quote No. 2/4877, C–50 Printing System, Nov. 27, 2000, 2 pgs.
Goldberg, Martin, Exhibit 69 to Deposition of Todd Coningsby, E–mail Correspondence, Oct. 14, 2001, 3 pgs.
Goldberg, Martin, Exhibit 70 to Deposition of Todd Coningsby, E–mail correspondece, Jan. 31, 2002, 1 pg.
Theuvenin, Jacques L., Exhibit 71 to Deposition of Todd Coningsby, E–mail correspondence, Feb. 26, 2002, 1 pg.
Theuvenin, Jacques, Exhibit 72 to Deposition of Todd Coningsby, E–mail correspondence, Feb. 27, 2002, 1 pg.
Cork Printer List, Exhibit 73 to Deposition of Todd Coningsby, 1 pg.
Apex Machine Company, Exhibit 74 to Deposition of Todd Coningsby, Invoice 41148, Bill of Lading, Copy of Check No. 8277, 1997, 3 pgs.
Apex Machine Company, Exhibit 75 to Deposition of Todd Coningsby, Invoice No. 43690, Copies of Check Nos. 365639 & 366611, 1998, 5 pgs.
Apex Machine Company, Exhibit 76 to Deposition of Todd Coningsby, Invoice No. 43944, Copies of Check No. 10753, Wire Transfer Record, 1999, 4 pgs.
Deposition of Massimo Verona, Jul. 2–3, 2003, pp. 18–19, 24–27, 33–41, 58–68, and 71–80.
Massimo Verona, Exhibit 18 to Deposition of Massimo Verona, Jul. 2, 2003, one page.
Massimo Verona, Exhibit 19 to Deposition of Massimo Verona, Jul. 2, 2003, one page.
Massimo Verona, Exhibit 20 to Deposition of Massimo Verona, Jul. 3, 2003, one page.
Omso, Manual for Tubest DM 129/16M; 83 pages.

* cited by examiner

DRY OFFSET ROTARY PRINTER FOR LABELING WINE CORKS

TECHNICAL FIELD AND BACKGROUND OF THE INVENTION

This invention relates to automated printing machines; and more particularly, to dry offset printing machines. As the demand for wine has increased, so has the demand for natural cork stoppers. To reduce demand for natural cork stoppers, containers other than bottles requiring cork stoppers, such as collapsible bags in boxes and bottles with screw cap lids, have been used. However, the buying public typically perceives collapsible bags stored in boxes with exposed spigots and screw cap bottles as indicators of inferior quality wine. To meet the demand for cork stoppers, synthetic cork stoppers have been developed. These synthetic cork stoppers are made from polymeric materials that have been extruded, or molded during a molding process. These synthetic corks have characteristics similar to their natural counterparts.

In the wine industry, corks are frequently printed with words and other indicia identifying the vineyard where the wine was produced or where the wine is bottled. Printing of natural cork stoppers is typically done using a rotary letter press or rotary letter flex printing system which utilizes a reverse reading hard or soft printing plate which has ink placed on the raised surface. The raised surface of the plate then makes contact with the natural cork, thus transferring the appropriate image. This printing process is typically limited to single color printing.

Printing machines used for printing indicia on natural cork stoppers have been found to be ineffective when used with synthetic cork stoppers. The synthetic stoppers are not as absorbent as natural cork and the printing on such corks, regardless of transfer method, require a forced drying of the printed ink. Additionally, the synthetic corks have a lower coefficient of friction at their surface and require a surface treatment, which oxidizes the surface allowing the printing ink to "flow out" when applied to the surface.

Therefore it would be advantageous to have a printing machine capable of imprinting synthetic cork stoppers with forced surface pretreatment and forced ink drying. It would also be advantageous to have a printing machine capable of printing synthetic cork stoppers that more securely holds the synthetic stoppers to reduce the likelihood of machine jams. It would also be advantageous to have a printing machine capable of printing synthetic cork stoppers which is more compact than previously known synthetic cork printing machines.

SUMMARY OF THE INVENTION

Therefore, it is an object of the invention to provide a printing machine capable of imprinting synthetic cork stoppers with little smearing.

It is another object of the invention to provide a printing machine capable of printing synthetic cork stoppers that more securely holds the synthetic stoppers to reduce the likelihood of machine jams.

It is another object of the invention to provide a printing machine capable of printing synthetic cork stoppers which is more compact than previously known synthetic cork printing machines.

It is another object of the invention to provide a printing machine which completely processes a synthetic cork in a single, continuous process.

It is another object of the invention to provide a printing machine which imprints synthetic corks which includes both forced surface treatment before printing and forced drying of the cork after printing.

These and other objects of the present invention are achieved in the preferred embodiments disclosed below by providing a rotary printing machine for the printing of synthetic cork stoppers of the type having a surface which is normally non-ink receptive. A Ferris wheel mechanism is provided, having a plurality of evenly spaced carriers mounted a predetermined radial distance from and parallel to the axis of rotation for the Ferris wheel mechanism, each carrier for rotatably holding a synthetic cork stopper. An indexing drive system controls incremental rotation of the Ferris wheel mechanism through a predetermined sequence of steps, and a cork feeder introduces a single synthetic cork stopper into each of the carriers as empty ones of the carriers are presented one-by-one at the cork feeder. A corona discharger treats the surface of each synthetic cork stopper prior to being printed with sufficient energy to alter the surface energy of the cork sufficiently to permit receptivity of printing ink. A rotary printing system rotatably imprints with ink the surface of each held synthetic cork stopper with an image.

According to one preferred embodiment of the invention, a carrier driver is provided for rotating each cork stopper as the surface of the stopper is being treated by the corona discharger.

According to another preferred embodiment of the invention, the Ferris wheel mechanism further comprises a coaxially-mounted drive axle coupled to the indexing drive system, and two parallel, spaced apart circular plates coaxially mounted on the drive axle.

According to yet another preferred embodiment of the invention, each carrier further comprises a stationary holder rotatably mounted on one of the plates, a movable holder rotatably mounted on the other of the plates opposite the stationary holder, the moveable holder being moveable between an open position and an engaged position with respect to the stationary holder such that when in the open position the synthetic cork stopper drops out of the carrier and the Ferris wheel mechanism and when in the engaged position the synthetic cork stopper is held between the moveable and stationary holders; and movement means for moving the moveable holder between the open and engaged positions.

Preferably, the stationary holder and moveable holder have concave surfaces for receiving the ends of the synthetic cork stopper.

According to yet another preferred embodiment of the invention, the stationary holder and moveable holder are removably mounted on their respective plates.

According to yet another preferred embodiment of the invention, the stationary holder and moveable holder each further comprise a removably mounted cup for holding the synthetic cork.

According to yet another preferred embodiment of the invention, a slip clutch is provided for interconnecting the drive axle to the indexing drive system means.

According to yet another preferred embodiment of the invention, the printing machine includes a plurality of carrier spin drivers positioned adjacent the Ferris wheel mechanism at each step where the synthetic cork stopper is being treated, printed and dried, each carrier spin driver having a continuously rotating drive wheel, and a spin pulley coaxially mounted on one of the rotatable holders in each carrier, the spin pulley removably engageable with the drive wheel of a carrier spin driver when the carrier is positioned at a step where the synthetic cork is being treated, printed and dried.

According to yet another preferred embodiment of the invention, the dry offset rotary printing means further comprises a plurality of rotary print heads with each print head providing a different color in an imprinted image.

According to yet another preferred embodiment of the invention, the Ferris wheel mechanism further comprises a coaxial, rotatably mounted drive axle coupled to the indexing drive system means and a circular plate coaxially mounted on the drive axle.

According to yet another preferred embodiment of the invention, each carrier further comprises a stationary holder rotatably mounted on the surface of the plate and a mounting arm mounted on the surface of the plate adjacent each stationary holder. A movable holder is rotatably mounted on the mounting arm opposite the stationary holder, and is moveable between an open position and an engaged position with respect to the stationary holder such that when in the open position the synthetic cork stopper drops out of the carrier and the Ferris wheel mechanism and when in the engaged position the synthetic cork stopper is rotatably held between the moveable and stationary holders. Movement means permit movement of the moveable holder between the open and engaged positions.

According to yet another preferred embodiment of the invention, the printing machine further comprises a plurality of carrier spin drivers positioned adjacent the Ferris wheel mechanism at each step where the synthetic cork stopper is being treated, printed and dried, each carrier spin driver having a continuously rotating drive wheel, and a spin pulley coaxially mounted on one of the rotatable holders in each carrier, the spin pulley removably engageable with the drive wheel of a carrier spin driver when the carrier is positioned at a step where the synthetic cork is being treated, printed and dried.

An embodiment of the method for printing indicia on synthetic cork stoppers according to the invention comprises the steps of introducing a single synthetic cork stopper of the type having a normally non-ink receptive surface into a carrier of a Ferris wheel mechanism, treating the synthetic cork stopper surface prior to being printed to render the surface at least temporarily receptive to printing ink, rotatably imprinting an image on the surface of the synthetic cork stopper in the carrier of the Ferris wheel mechanism, drying the ink on freshly imprinted synthetic cork stopper, indexing the rotation of the Ferris wheel mechanism to present the carrier of the Ferris wheel mechanism to stations for treating, imprinting, and drying corks held in the carriers of the Ferris wheel mechanism.

According to one preferred embodiment of the invention, the method includes the step of moving a moveable holder of the carrier with respect to a stationary holder of the carrier between an open position and an engaged position such that the synthetic cork stopper drops out of the carrier in the open position and the synthetic cork stopper is held between the moveable and stationary holders in the engaged position.

According to another preferred embodiment of the invention, the method disengaging a drive axle from an indexing drive system in response to a jam so that the indexing rotation ceases.

In alternative embodiments, the carriers are removably mounted in the Ferris wheel mechanism, the carriers have removable cups used for holding the synthetic corks, and the carriers may be independently rotated at various carrier positions using a carrier spin drive. In other embodiments, the Ferris wheel mechanism comprises a single circular plate mounted on the drive axle with the cork stopper carriers mounted on one side of this plate. Further, a slip clutch mechanism may be provided between the Ferris wheel mechanism and the indexing drive system to reduce the likelihood of damage to the indexing drive should jams occur.

Because each cork is individually held in place during the steps of corona treatment, printing and drying, the down time caused by corks not properly releasing from the print drums is reduced. Further, the Ferris wheel mechanism allows a misfed cork to drop through the mechanism and out of the machine. Lastly, because the carriers and/or their cups are readily removable, the printing machine of the present invention may be quickly retooled for use with a variety of lengths and diameters of synthetic corks.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
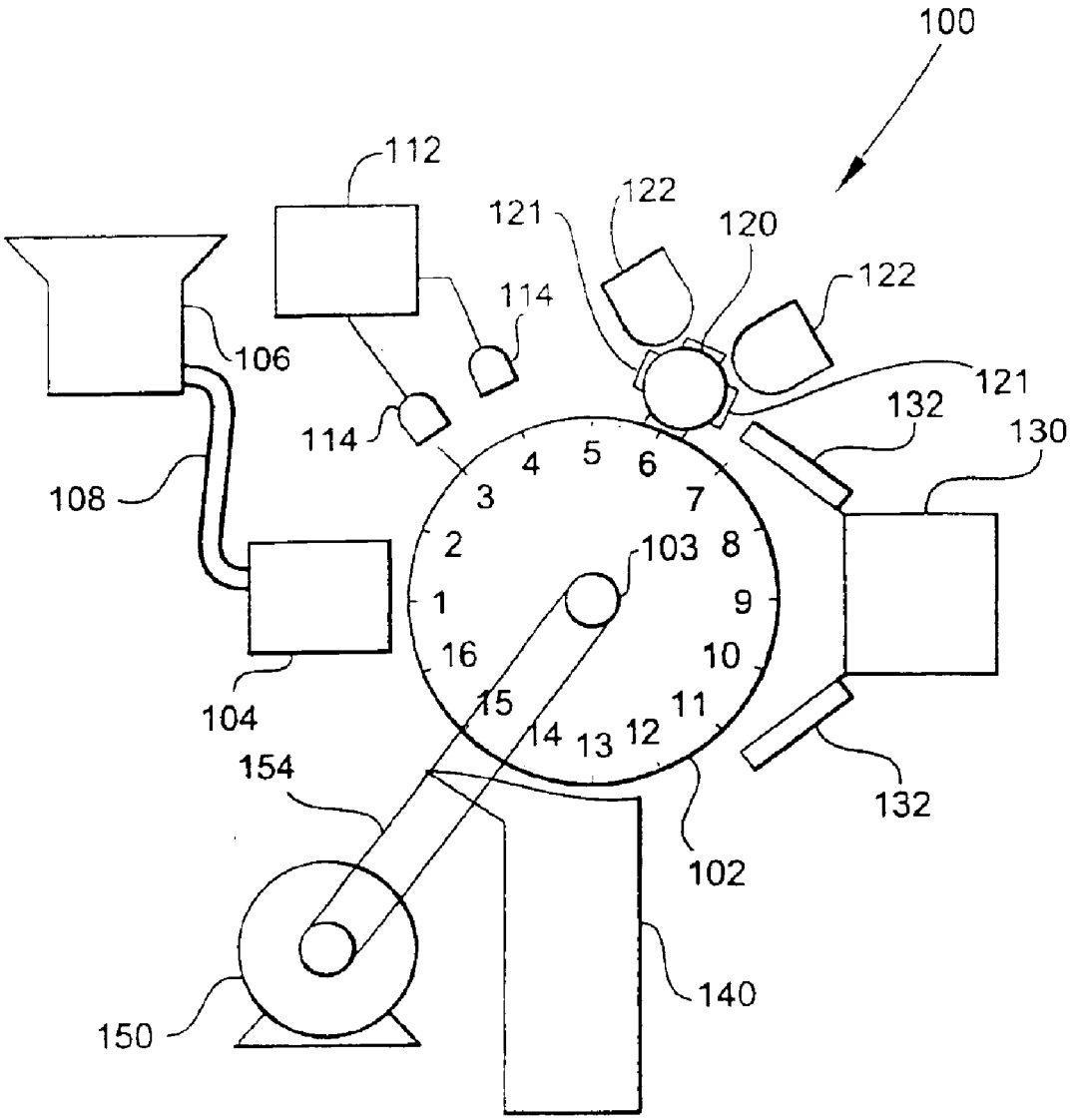
FIG. 1 is a schematic representation of a dry offset rotary printing machine according to one embodiment of the present invention.

Referring now specifically to the drawings, a cork printer according to the present invention is illustrated in FIG. 1 and shown generally at reference numeral 100.

As used herein, the terms "cork," "corks," and "cork stopper" refer to synthetic and natural cork stoppers. Elements having the same or similar functions in the various Figures have similar reference numerals.

FIG. 1 illustrates a dry offset rotary printing machine 100 used for the printing of synthetic cork stoppers. The printing machine 100 comprises a rotatable Ferris wheel mechanism 102 having a plurality of evenly spaced carriers mounted a pre-determined radial distance from and parallel to the axis of rotation of Ferris wheel mechanism 102. Each carrier rotatably holds a synthetic cork stopper to be treated, printed and dried in the machine. Ferris wheel mechanism 102 illustrated in FIG. 1 has sixteen carrier positions, numbered 1 through 16. Each of these positions has a cork stopper carrier although it is not required. A larger or smaller number of carriers may be provided based on design choice. The vertical orientation of the Ferris wheel advantageously decreases the amount of floor space needed for the footprint of machine 100.

Shown mounted adjacent to carrier position 1 is feed mechanism 104. This mechanism introduces a single cork into each of the carriers as the carriers rotate past feed mechanism 104. A cork supply bin 106 attaches to cork feed mechanism 104 via a feed tube 108. Cork feed mechanism 104 is further explained with reference to FIG. 3.

Shown at positions 3 and 4 is a dual corona discharge treating unit 112 having corona discharge heads 114 positioned adjacent carrier positions 3 and 4 so that the corona discharge impinges upon the surface of the cork stoppers held in the carriers at those positions. Preferably, corona unit 112 is a Dual Spot Generator, Model No. 7107D02 manufactured by Tantec, Inc. of Schaumburg, Ill. Corona treating of the synthetic corks allows the cork surface to better accept the inks used in a dry rotary offset printing.

Mounted adjacent carrier position 6 is an offset rotary transfer print drum 120. Shown positioned adjacent to the rotary drum 120 are two dry offset rotary print heads 122. Each print head includes a continuously driven ink fountain roller with a roller inking arrangement. Print heads 122 transfer an inked image onto one or more raised surfaces or platens 121 of print drum 120 which then transfers the ink image onto the surface of the cork stopper located at carrier position 6. Print drum 120 is positioned so that platens 121 contact both the surface of a cork stopper at position 6 and the image plate in print heads 122 in their rotation. The width of raised platen 121 are typically slightly less than the length of the longest cork stopper to be printed. The length of raised patent 121 is about equal to or longer than the circumference of the largest diameter cork stopper to be printed. The print heads preferably used in the present invention are Model Half Size 6-3000 Series print heads manufactured by Apex Machine Company of Ft. Lauderdale, Fla. Other types of dry offset printing systems may be used with the Ferris wheel mechanism.

Mounted adjacent to carrier position 7 through 11 is ultraviolet (UV) drying or curing assembly 130 that dries freshly imprinted corks at those positions. The drying assembly 130 comprises an UV light along with fan and drying elements 132 extending therefrom and about Ferris wheel mechanism 102. Preferably, the UV drying assembly 130 is a Model UVPAK manufactured by Fusion AETEK UV Systems, Inc. of Romeoville, Ill. Other types of drying or curing assemblies may be used.

Shown adjacent to carrier positions 13 through 15 is bin 140 that collects the dried imprinted corks exiting the machine, typically at carrier position 14 or 15. Attached to drive axle 103 of Ferris wheel mechanism 102 via belt 154 is an indexing drive system 150, such as a servo motor or mechanical cam indexer. The indexing drive system controls the rotation of the Ferris wheel mechanism through a predetermined sequence of steps at which the various operations are performed. These steps are the feeding of a synthetic cork into carriers at carrier position 1 and then rotating the Ferris wheel mechanism and held corks through the carrier positions at which the held cork stoppers are corona treated, printed, dried and removed. In operation, indexing drive system 150 moves Ferris wheel mechanism 102 through a predetermined amount of rotation. For the 16 station unit shown, this would mean approximately 22.5° of rotation per step. The length of time at which Ferris wheel mechanism 102 is stopped at each station is determined primarily by the length of time needed to imprint the cork which occurs for the machine shown at carrier position 6. An indexing drive system for use in the present invention is Model P-325 indexer manufactured by Ferguson Company of St. Louis, Mo. A slip clutch mechanism as is known in the art (not shown) may be interconnected between indexing drive system 150 and drive axle 103 to reduce the likelihood of damage to the indexing drive and printing machine in the event that there is a jam in the printing machine. One such slip clutch mechanism is Model Size 1 manufactured by Mayr Corporation of Waldwick, N.J. or Torque Limiter Model 250A manufactured by Morse Industrial Corporation of Ithaca, N.Y.

Figure 2:
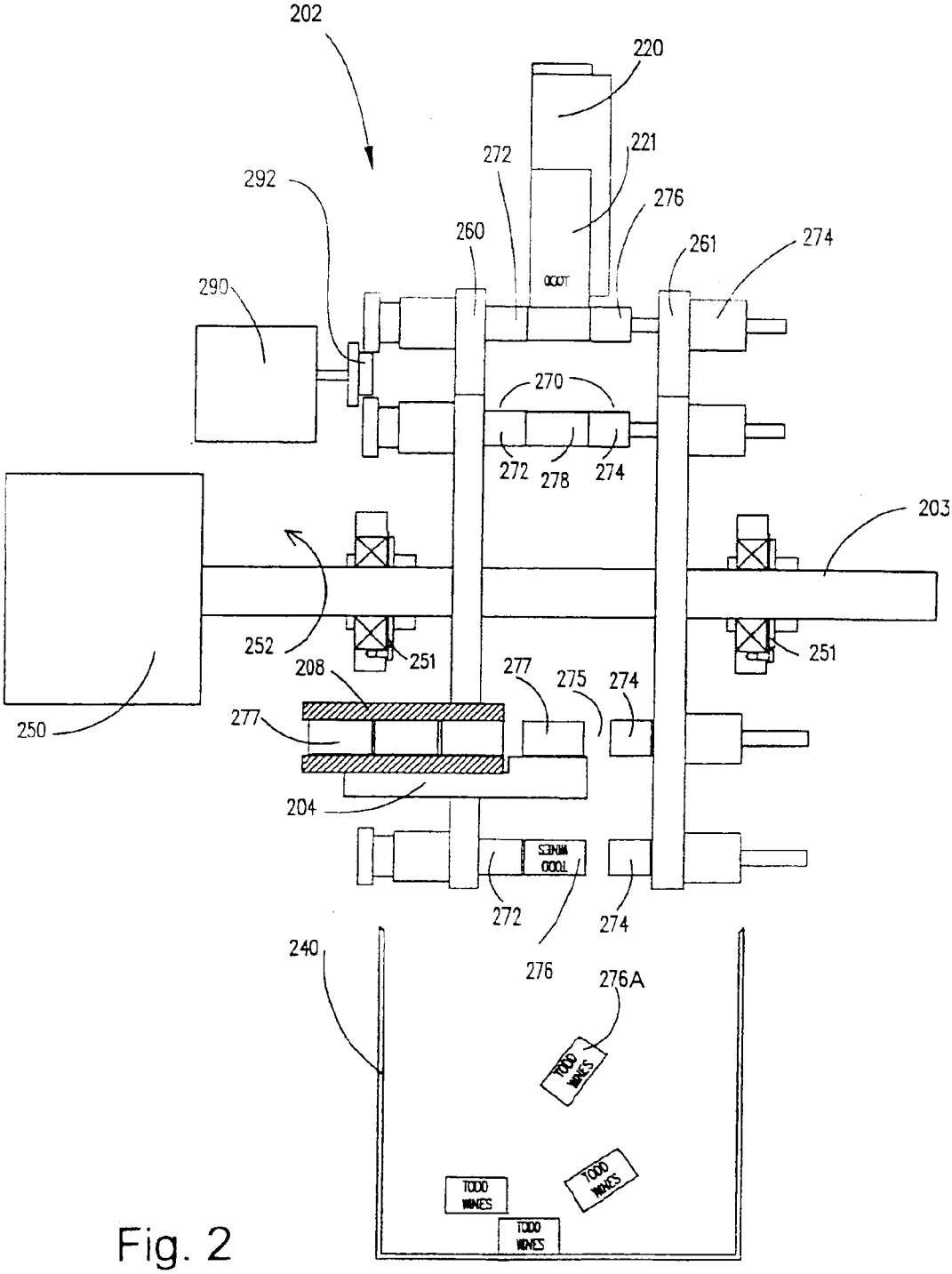
FIG. 2 is an elevational illustration showing the Ferris wheel mechanism, the printing of cork stoppers, as well as, schematically showing the indexing drive and the use of a carrier spin drive to independently rotate the carriers.

Ferris wheel mechanism 202 is shown in FIG. 2 and is comprised of a horizontally oriented, rotatably mounted drive axle 203 that is coupled to indexing drive system 250. Drive axle 203 is mounted in or on bearings 251 as is known in the art. Curved arrow 252 indicates the direction of rotation of Ferris wheel mechanism 202. Two parallel, spaced apart, preferably circular plates 260, 261 are coaxially mounted on drive axle 203 and support the cork stopper carriers positioned intermediate plates 260, 261. Plates 260, 261 may be solid or have a hub, spokes and rim arrangement. The number of carriers desired and the room needed to mount the various pieces of treating, printing and drying equipment about the outer circumference of Ferris wheel mechanism 202 determines the diameter of the plates. Alternatively, a single plate may be used to form the Ferris wheel mechanism. In this alternate embodiment, the carriers are positioned in a cantilevered fashion from one face of the plate. For example the stationary holder may be mounted on the surface of the plate while the opposite moveable contact is mounted on a C- or L-shaped arm extending outwardly from the plate's surface.

Each carrier 270 comprises a pair of opposed rotatable holders, one of which is stationary, the other moveable. Preferably, all of the stationary holders 272 mount on plate 260 with the corresponding moveable holders 274 mounting on plate 261. Other arrangements are possible and the exact arrangement is not critical. Both holders are rotatable in their mounted positions, and, preferably, both holders are removably mounted. Preferably, movable holders 274 are linearly movable between an open position 275 and an engaged position 276 with respect to their corresponding stationary holder 272 when cork stopper 278 is clamped in position. Moveable holder 274 may be moved between these two positions by springs, linkages, linear actuators or the like as is well known. At open position 275, a printed cork 276A drops out of carrier 270 and Ferris wheel mechanism 202 into container 240. Also new or unprinted cork 277 may be inserted into carrier 270. In the engaged position, held corks 278 are clamped between movable holder 274 and stationary holder 272 of each carrier 270. Unprinted cork 277 is shown on feed mechanism 204 waiting to be clamped into position. Cork feed tube 208 is shown filled with additional unprinted corks 277 queued up for entry into Ferris wheel mechanism 202. As shown there the cork stoppers are aligned along their longitudinal axis—the preferred orientation for the printing operation.

Print drum 220 is shown having an reverse ink image 221 which is brought into contact with surface 279 of cork 278 at carrier position 6 and rotatably prints the surface of this held cork. Also shown is carrier spin drive 290 that is used to rotate the carriers and any cork stopper held therein. Advantageously, this direct rotation of the cork stopper ensures that the cork stopper is effectively treated, printed and dried. Preferably at each carrier position at which a treating, drying or printing operation occurs, a carrier spin drive unit is provided. Spin drive unit 290 has a continuously spinning drive wheel 292 that engages a carrier to spin or rotate the carrier. Drive wheel 292 is shown engaging stationary holder 272 that is adjacent print drum 220. Moveable holder 274 may also be used to engage drive wheel 292.

Drive wheel 292 may engage more than one carrier at a time, depending, of course, on the diameter of the drive wheel used. Drive wheel 292 engages a carrier 270 as Ferris wheel mechanism 202 indexes into position. When Ferris wheel mechanism 203 indexes and rotates to the next position, the spinning carrier disengages from drive wheel 292 due to the rotational motion of Ferris wheel mechanism 203. Drive wheel 292 is sized so the drive wheel rotational path and carrier path are tangent or coincident only about a given carrier position or only about positions adjacent to that given position.

The use of the carrier spin drive allows the cork to be rotated when being treated, printed or dried. This ensures that the entire surface of the cork is properly treated at each of the respective stops in the machine. By providing a positive drive to the held cork rather than letting the held cork be rotated by the print drum, a better transfer of the inked image occurs. Drive wheel 292 comprises a pulley having a rubber O-ring or similar material in the groove of the pulley (see FIG. 4*b*). Spinning the carriers may be accomplished by means other than the drive wheel and spin pulleys. For instance, gears, belts or linkages may be used to achieve the same effect. A planetary gearing system may also be employed as is known in the art. Further, carrier rotation may be provided at every carrier position between carrier position 1 where new corks enter the Ferris wheel and the exit carrier positions.

Figure 3:
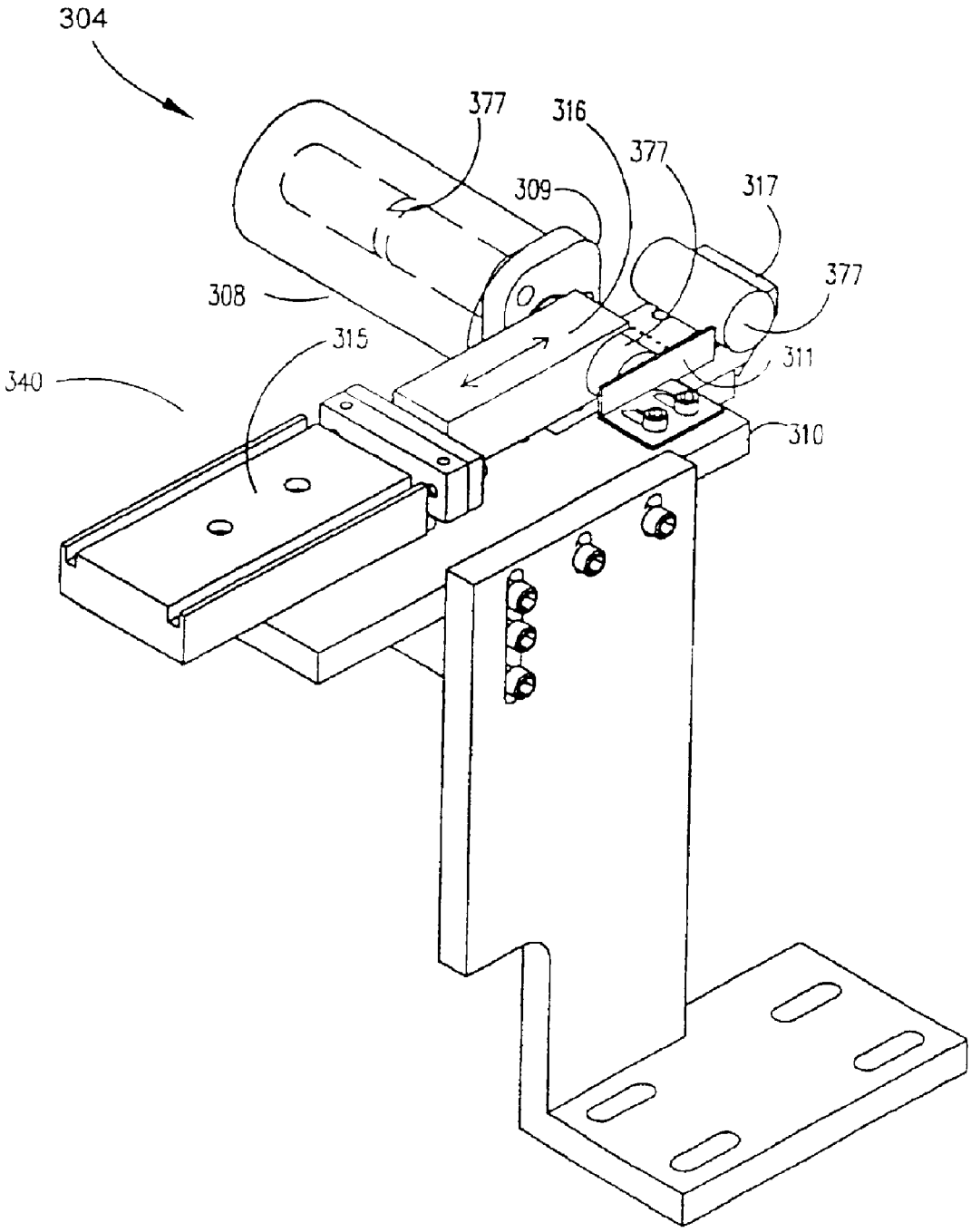
FIG. 3 is a detailed isometric view of the synthetic cork feed mechanism.

To load the carriers, a single cork is presented to each carrier as it is rotated into carrier position 1. FIG. 3 depicts feed mechanism 304 that performs this function. The exit end 309 of feed tube 308 is mounted to a receiving platform 310. In supply tube 308 and shown in dashed line are new synthetic cork stoppers 377. Stoppers 377 are queued and aligned in a single file ready to exit feed tube 308 and are biased to do so if a free space is available on receiving platform 310. Biasing preferably is done using a gravity feed system for the cork stoppers. Cork stopper 377 upon exiting feed tube 308 comes to rest against stop 311. Linear actuator 315 is positioned intermediate end 309 of supply tube 308 and stop 311. End 316 of linear actuator 315 adjacent the stopper is C- or U-shaped in cross section. This holds new cork stopper 377 in alignment as linear actuator 315 feeds the stopper into the Ferris wheel mechanism.

The double headed arrow indicates the reciprocal linear motion of linear actuator 315 into and away from the carriers. Positioned adjacent to and in line with end 316 of linear actuator 315 and attached to receiving platform 310 is holding cradle 317 on which positioned new cork 377 is shown. Holding cradle 317 is curved to approximately the same radius as that of the cork stopper to be printed. Should larger or smaller cork diameter stoppers need to be printed, the curvature may be adjusted or a new cradle having the appropriate curvature may be installed. When a carrier is present at carrier position 1, holding cradle 317 is positioned intermediate the stationary and moveable holders. A carrier engages or clamps cork 377 that is in holding cradle 317 and when the Ferris wheel mechanism is rotated to the next position, holding cradle 317 is emptied of its new cork stopper 377. As the next carrier is being rotated into carrier position 1, linear actuator 315 actuates and pushes new cork 377 adjacent stop 311 onto holding cradle 317. During the process of loading holding cradle 317 with the next new cork stopper 377, actuator 315 blocks exit end 309 of feed tube 308 preventing another new cork stopper 377 from exiting feed tube 308 until linear actuator 315 retracts to its rest position. Feed mechanism 304 reliably introduces a single synthetic cork stopper into each carrier when it reaches carrier position 1.

Figure 4A:
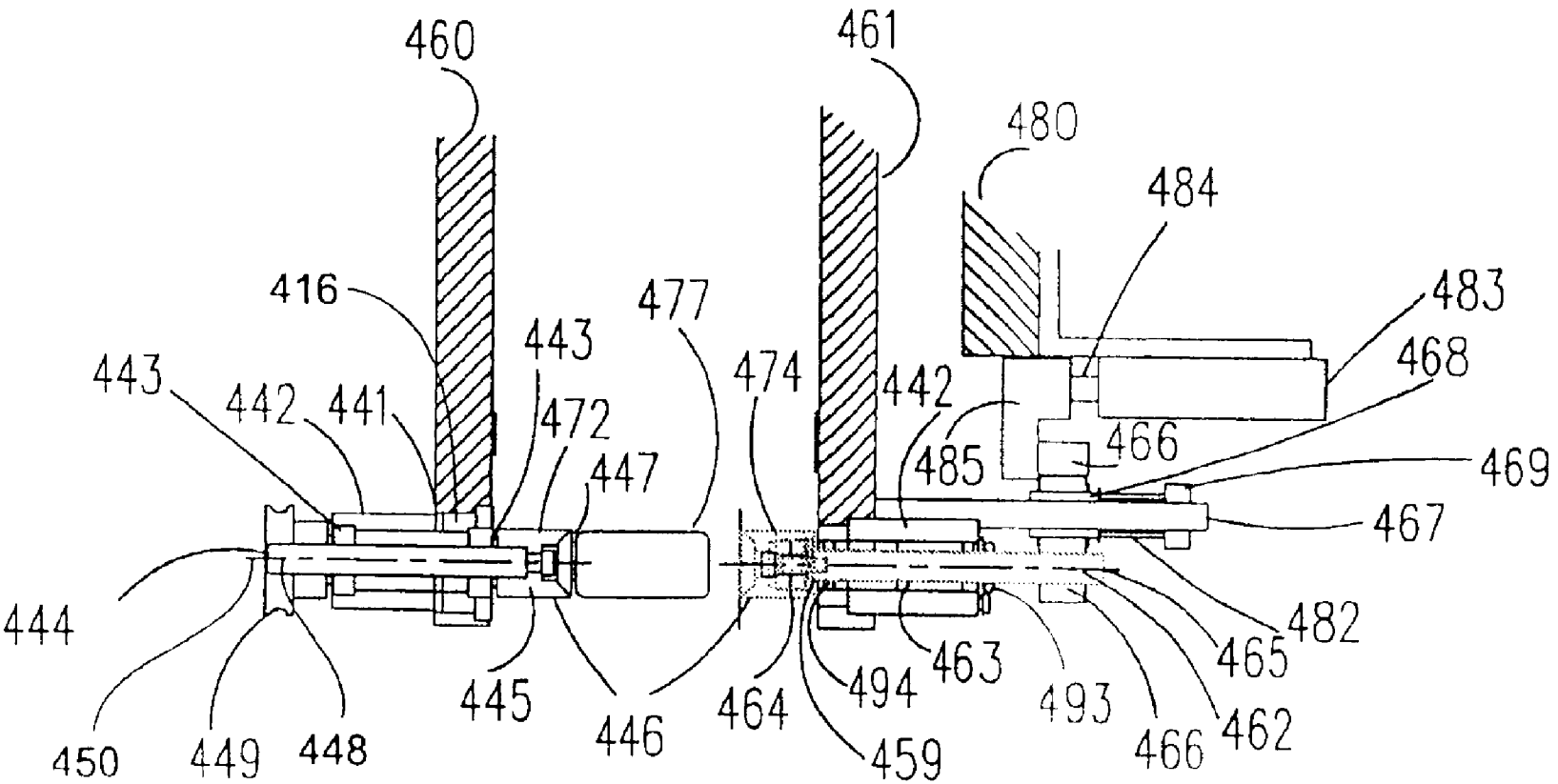
FIG. 4*a* is a partial sectional view illustrating the assembly of the synthetic cork carriers in both the open position.
Figure 4B:
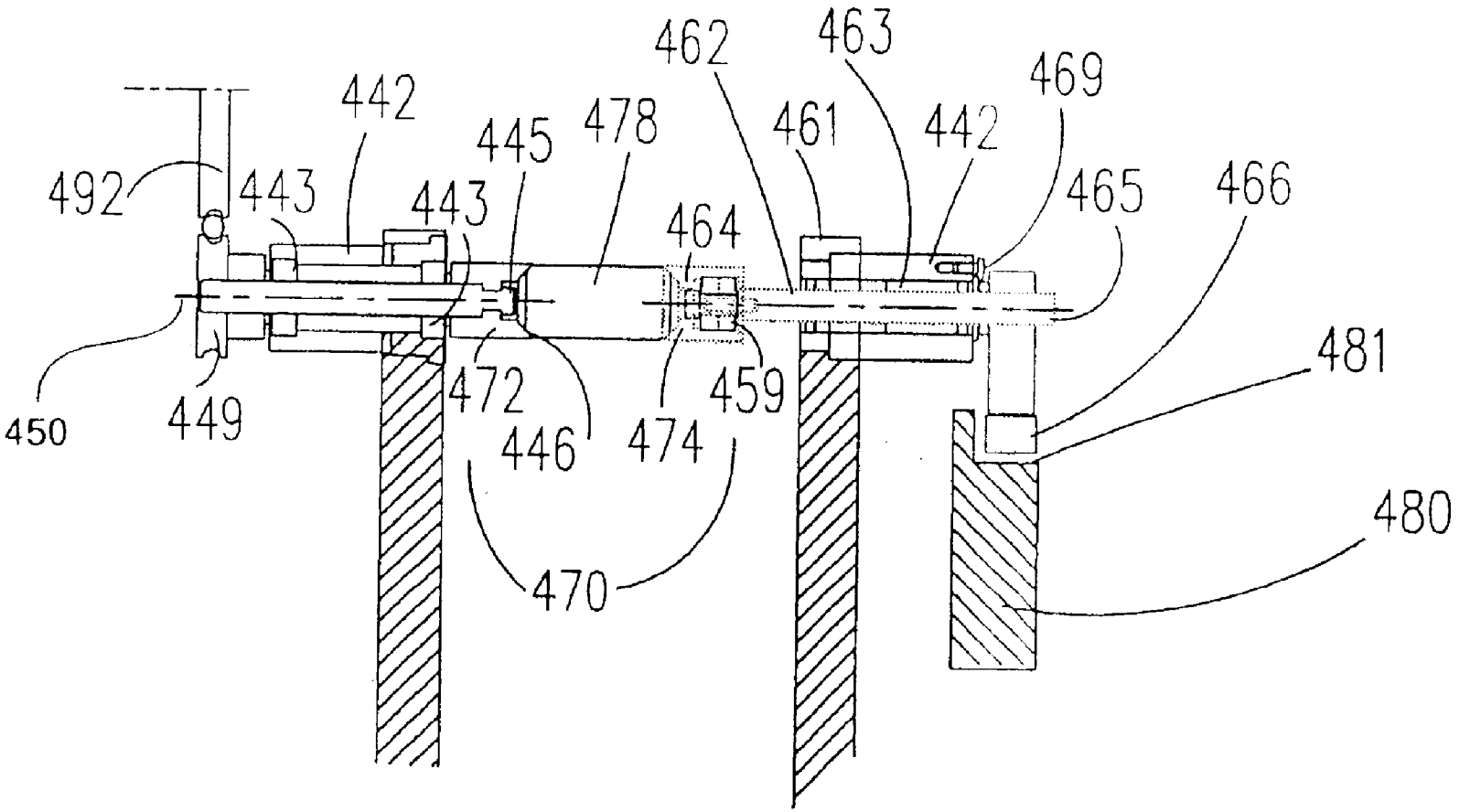
FIG. 4*b* is a sectional view illustrating the assembly of the synthetic cork carriers in the engaged position.

Referring now to FIGS. 4*a* and 4*b*, cork stopper carrier 470 is shown in the open and engaged positions, respectively. Stationary holder 472 mounts in an opening 441 provided in plate 460. Provided in opening 441 is hollow cylindrical housing 442 having at each end thereof circular bearings 443. Cylindrical rod 444 is inserted through bearings 416 and extends substantially perpendicularly and outwardly for each face of plate 460. End 445 of rod 444 between plates 460, 461 has removably mounted thereon cup 446 for engaging with or receiving an end of cork 477. Cup 446 can be attached by various means as is known in the art, including the use of threaded connections, keyed connections, or a bolt and nut connection. Cup 446 has a flat surface or face for holding a cork stopper or is a shaped face 447, such as a concave or convex face, corresponding to the shape of the ends of the cork stoppers to be printed. At opposite end 448 of rod 444 is removably mounted a spin pulley 449. The rod 444, spin pulley 449 and cup 446 rotate about axis 450 together as a unit in bearings 443.

Movable holder 474 is similarly constructed and is removably mounted on the other plate 461 of the Ferris wheel mechanism. Because movable holder 474 is linearly movable there are some differences in its construction. Cylindrical rod 462 in movable holder 474 is longer than rod 444 of stationary holder 472 and is mounted in linear bearing 463 allowing rod 462 and cup 464 to be linearly moveable between the open and engaged positions. An O-ring seal 493 is provided where rod 462 exits housing 442. Another seal 494 is provided at the other end of housing 442 where rod 462 is removably and rotatably connected to cup 464. These seals protect the linear bearing from contaminants such as dirt and debris. Because of the use of a cam follower and guide bar arrangement that is described with reference to FIGS. 4*a*, 4*b*, and 5, cup 464 is rotatably mounted on end 459 of rod 462 and rotates about axis 450. The face of cup 464 that engages the end of a cork stopped is shaped as previously described for cup 446. The added length in rod 462 allows movable holder 474 to receive or contact an end of cork 477 when placed in the engaged position. The end of cup 464 has an opening that receives end 459 of rod 462. The opening may be fitted with a circular bearing. Because cups 446, 464 are removable, cups having different profiles may be used to accept cork stoppers having ends with configurations different from typical corks, such as champagne cork stoppers.

As previously described, when in the proper position to do so, spin pulley 449 engages with drive wheel 492 rotating carrier 470 and held cork stopper 478 about the centerline of carrier 470. Preferably, each carrier 470 and/or cups 446 and 464 mounts, as is known in the art, to be readily removed to allow for retooling with different sizes carriers or cups should a substantially large or smaller diameter synthetic cork stopper need to be printed. The cups have approximately the same diameter as the cork stoppers that are to be printed.

Various subsystems may be used to transfer moveable holder 474 between the open and engaged positions. One such subsystem is described with reference to FIG. 4*a*. Attached adjacent to exterior end 465 of rod 462 (FIG. 4*a*) is cam follower 466 which depends in a direction perpendicular to the centerline of rod 462. Guide rod 467 mounts to plate 461 adjacent and parallel to rod 462. Sleeve 468 slideably mounts on guide rod 467 and contains therein a linear bearing (not shown) which rides on guide rod 467. Cam follower 466 attaches to sleeve 468. The free end of guide rod 469 inserts in clamp collar 469 which is adjustably fixed in position on guide rod 467. Mounted and compressed between sleeve 468 and collar 469 is spring 482 which biases holder 474 toward the engaged position and provides clamping force for holding the cork stopper. Stationary cam 480 is circular in shape and cut into its outer edge or rim is a step that forms an circular track 481 having an L-shaped cross section that extends outwardly from Ferris wheel mechanism. Cam follower 466 traverses track 481 as the Ferris wheel mechanism rotates through the various carrier positions. Guide rod 467 keeps cam follower 466 radially aligned with the axis of rotation of the Ferris wheel mechanism and in track 481 as cam follower 466 traverses track 481.

Linear actuator 483, such as an hydraulic or pneumatic cylinder, mounts on bracket 486 that, in turn, fastens to the exterior face of stationary cam 480 mounted on the drive axle and positioned adjacent plate 461. The portion of cam 480 and segment of track 481 adjacent carrier position 1 is notched out. Inserted into the notch is cam block 485 that is sized to be closely received in the notch and which is also attached to drive rod 484 of linear actuator 483. Cam block 485 also has an L-shaped track corresponding to track 481 cut into its outer edge such that when drive rod 484 extends the track in cam block 485 it aligns with track 481 in cam 480. For a 16 carrier Ferris wheel mechanism the length of the track segment on the cam block spans an arc of approximately less than 20 degrees.

When a cam follower traverses onto the track segment in cam block 485, linear actuator 483 actuates. On actuation, drive rod 484 retracts which linearly moves cam block 485 outwardly from the exterior face of cam 480. Cam follower 466 also moves in the same direction linearly moving sleeve 468, rod 462, and cup 464. This action transfers movable holder 474 to the open position and further compresses spring 482 (See FIG. 4*a*). When linear actuator 483 deactivates, cam block 485 returns to its position aligned with cam 480 moving moveable holder 474 into the engaged position and clamping a cork resting in the feed cradle. The Ferris wheel mechanism indexes and the process repeats for the next cork stopper. A second linear actuator, second notch and second cam block may be provided at the exit station to remove the dried printed corks from each carrier by transferring the moveable holder from the engaged position to the open position as just described. If the cork exit position and the cork feed position are adjacent, a single actuator and a cam block having a longer track segment may be used as means to move the movable holder between the open and closed positions. Other arrangements as are known in the art may be used to transfer movable holder 474 between the open and engaged positions at both the cork feed position and the cork exit position.

In FIG. 4*b*, movable holder 474 is shown in the engaged position with held cork 478 clamped between the holders. Cam follower 466 is shown traversing track 481. The moveable holder 474 remains in this position until held cork reaches the exit position. When the printed and dried cork reaches the exit position, typically carrier position 14 or 15, movable holder 474 retracts to allow the printed and dried cork to exit the Ferris wheel mechanism and the machine.

Figure 5:
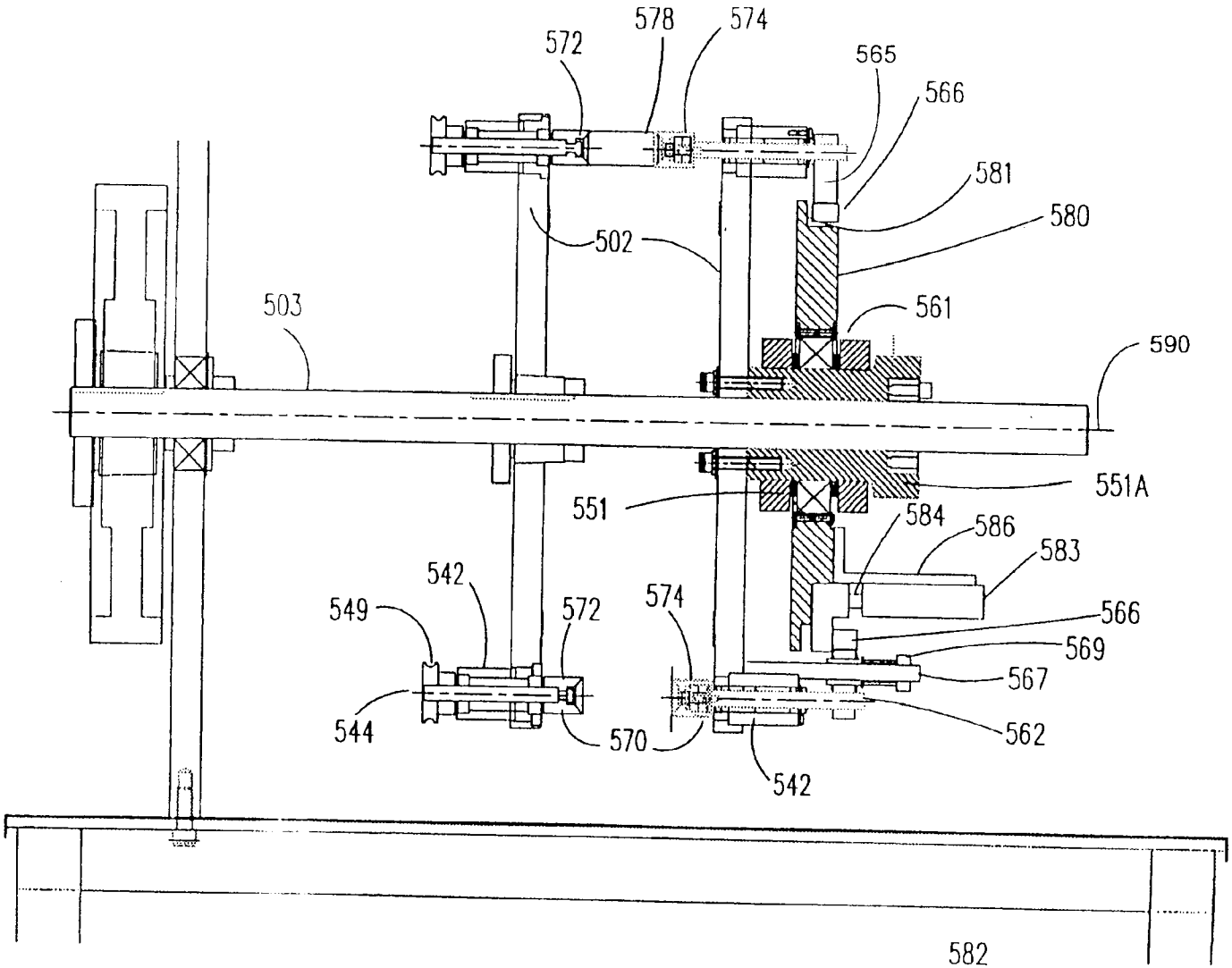
FIG. 5 is a partial sectional view of the machine illustrated in the above Figures showing the cam and cam follower used to move the movable carrier between the open and engaged positions.

Referring to FIG. 5, the mounting arrangement of cam 580 and cam follower 565 is seen. Cam 580 is fixed in position relative to rotating Ferris wheel mechanism 502. Cam 580 is shown mounted adjacent plate 561 on bearing assembly 551A that is mounted on drive axle 503. Bearing assembly 551 allows Ferris wheel mechanism 502 to rotate about axis 590 but allows cam 580 to remain stationary. Cam follower 566 follows track 581 as Ferris wheel mechanism 502 rotates. In lieu of the linear actuator and cam block used at the exit position, the width of the track can be configured to narrow in the vicinity of the exit position thereby linearly shifting moveable holder 574 into the open position.

Figure 6:
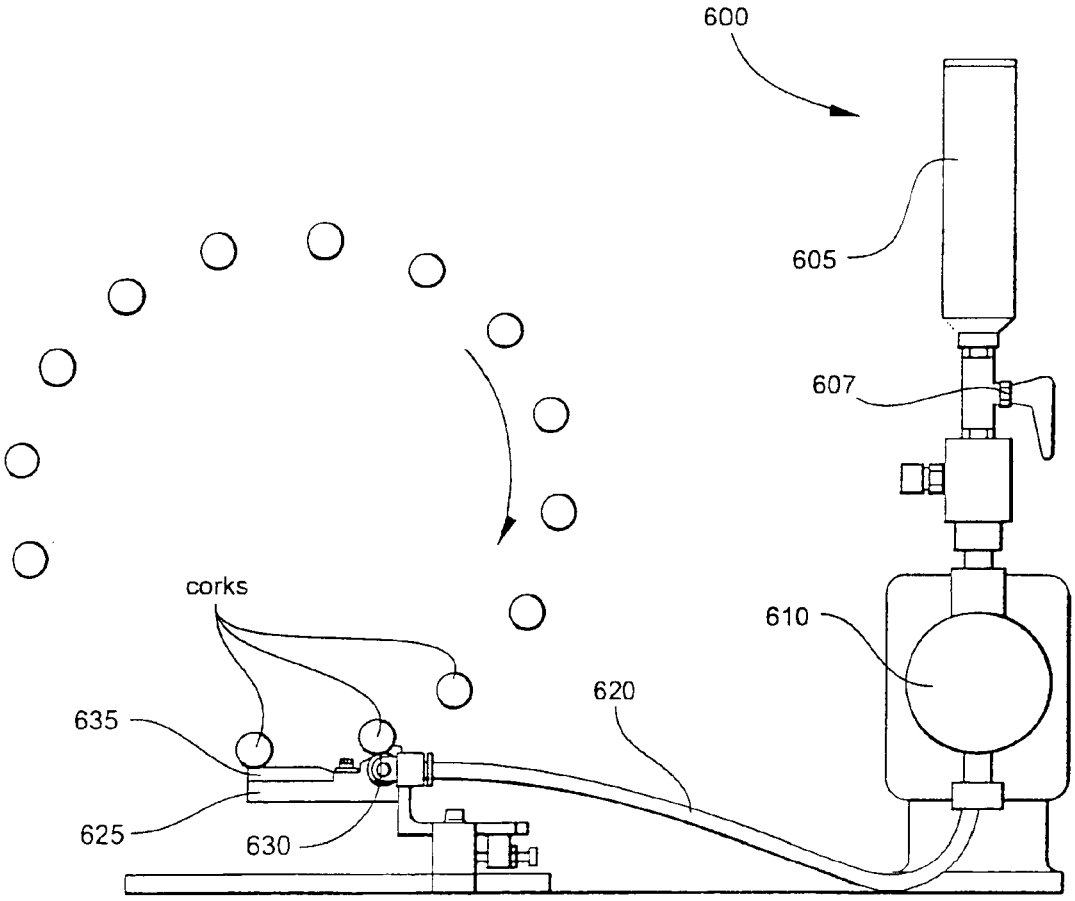
FIG. 6 is a side elevational view of the silicone application station of the printing machine.

Referring now to FIG. 6, the silicone application station 600 applies a thin film of food grade silicone to the surface of the cork after printing. It is important that the silicone be applied evenly to the cork, as it serves to lubricate the cork during subsequent insertion into the bottle. It is also important that no silicone be inadvertently applied to the chucking elements. Silicone on the chucking elements may be transferred back to the printing blanket, causing contamination of the printing process. Silicone from a reservoir 605 flows through shut off valve 607 to a metering pump 610.

The metering pump 610 is a commercially available model A7771-155HV from LMI. The metering pump 610 is controlled by the PLC of the printer 100. The user can preset the amount of silicone to be applied. The amount of silicone pumped during each pump cycle is controlled at the pump 610. Pump cycle frequency is controlled by the PLC. A precise quantity of silicone is therefore supplied by pump 610 via a hose 620 to the application station 625. A line of holes placed in manifold 630 allows the silicone to form droplets on the upper surface of the manifold 630. The droplets contact the surface of the cork as it is indexed from the ink drying station 130 where the corks are dried by curing the UV ink just applied. The cork with the silicone applied to its surface is then indexed into contact with a medical grade sponge 635. The cork is driven via an external drive (not shown) causing it to rotate in contact with the sponge 635. The sponge 635 transforms the droplets of silicone into a uniform film coating the entire surface of the cork except the ends held by the chucking device (not shown). The position of the holes in the manifold 630 and the width of the sponge 635 limit the area of silicone application to the cork, thus preventing silicone from be transferred to the chucking devices.

One advantage to this system is that the silicone is applied to the cork during the printing process. Other methods require additional handling. In typical prior art processes, the printed corks are placed in a large tumbler, silicone is added to the tumbler and the mixture of corks and silicone tumbled for a suitable amount of time. By directly applying the silicone within the printing system the additional handling and time required are eliminated. Another prior art method of applying the silicone requires the silicone be sprayed onto the surface of the cork. This method involves an expensive spray system because of the very small quantity of silicone being applied. Spraying also requires some method of transferring the cork from the printing device to the spraying device without the possibility of silicone migrating back to the printing system. The silicone application station 600 described here eliminates these problems.

Figure 7:
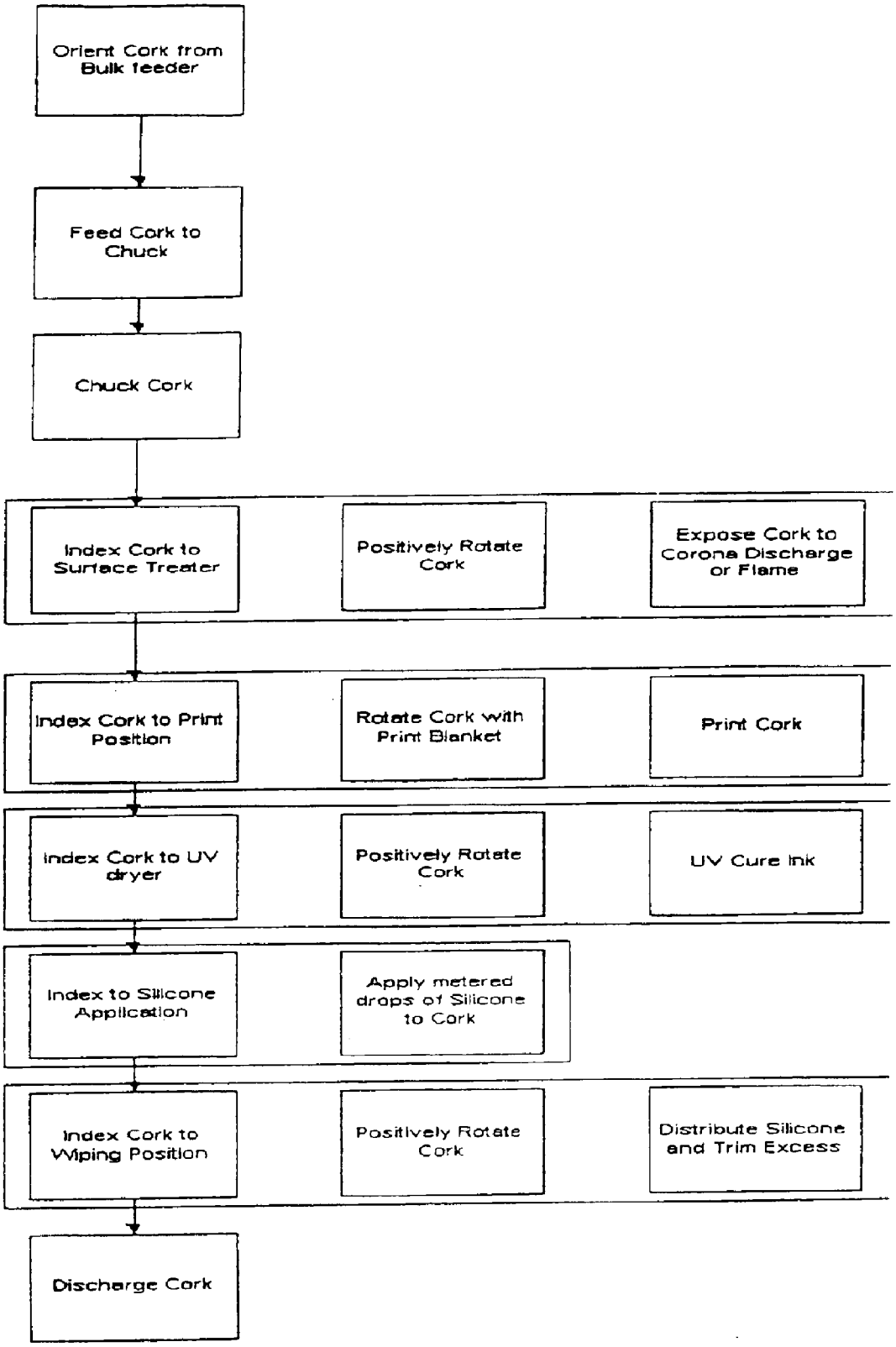
FIG. 7 is a flow diagram of a preferred embodiment of the process according to a preferred embodiment invention.

The operation of the rotary printing machine 100 according to a preferred embodiment of the invention, and the related process, is illustrated and summarized in FIG. 7.

Use of a dry offset rotary printer permits multiple colors to be employed in the images that are imprinted, unlike natural cork printing machines using the Gravure process. Further, the means to move the movable holder between the open and engage positions and from engaged to the opened position are not critical. Linear actuators or cams and cam followers as described may be used or other means as is known in the art may be used to move the movable holder. Although the movable holder is described as being linearly moveable between positions, it is also understood to those in the art that the moveable holder may move in a nonlinear fashion such as swinging through an arc.

A printing machine for printing synthetic corks is described above. Various details of the invention may be changed without departing from its scope. Furthermore, the foregoing description of the preferred embodiment of the invention and the best mode for the invention are provided for the purpose of illustration only and not for the purpose of limitation—the invention being defined by the claims.

I claim:

1. A printing machine for printing stoppers of the type having a surface that is normally non-ink receptive, comprising:

(a) a rotatable carrier assembly having a plurality of carriers mounted for rotation, each of the carriers adapted for holding and carrying at least one stopper;

(b) an indexing drive system for controlled incremental rotation of the carrier assembly through a predetermined sequence of steps;

(c) a bulk hopper for holding a supply of stoppers in preparation for being fed to the rotatable carrier assembly;

(d) an orienting apparatus for orienting a single stopper into a loading position relative to the carriers;

(e) a feeder for introducing an oriented stopper into selected ones of empty carriers presented one-by-one at the feeder;

(f) a heat generator for heating the surface of each stopper prior to being printed sufficiently to alter the surface energy of the and permit receptivity of printing ink onto the surface of the stopper; and (g) a printing system for imprinting with ink the surface of each held stopper with an image.

2. The printing machine of claim 1, and further comprising a carrier driver for rotating each at least one stopper as the surface of the stopper is being treated by the heat generator.

3. The printing machine of claim 1 wherein the rotatable carrier assembly is coaxially mounted on a drive axle coupled to the indexing drive system and further comprises:

(a) two parallel, spaced apart circular plates coaxially mounted on the drive axle; and each carrier further comprising:

(i) a stationary holder rotatably mounted on one of the plates;

(ii) a movable holder rotatably mounted on the other of the plates opposite the stationary holder, the moveable holder being moveable between an open position and an engaged position with respect to the stationary holder such that when in the open position the stopper drops out of the carrier, and when in the engaged position the stopper is held between the movable and stationary holders; and (b) movement means for moving the movable holder between the open and engaged positions.

4. The printing machine of claim 1 wherein the carrier assembly further comprises:

(a) a coaxial, rotatably mounted drive axle coupled to the indexing drive system;

(b) a circular plate coaxially mounted on the drive axle; and (c) each carrier further comprising:

(i) a stationary holder rotatably mounted on the surface of the plate;

(ii) a mounting arm mounted on the surface of the plate adjacent each stationary holder;

(iii) a movable holder rotatably mounted on the mounting arm opposite the stationary holder, the moveable holder being moveable between an open position and an engaged position with respect to the stationary holder such that when in the open position the stopper drops out of the carrier, and when in the engaged position the stopper is rotatably held between the moveable and stationary holders; and (iv) means for moving the moveable holder between the open and engaged positions.

5. The printing machine of claim 4, and further comprising:

(a) a dryer for drying the stoppers after printing;

(b) a plurality of carrier spin drivers positioned adjacent the carrier assembly at each location where the stopper is being treated, printed and dried, each carrier spin driver having a continuously rotating drive wheel; and (c) a spin pulley coaxially mounted on one of the rotatable holders in each carrier, the spin pulley removably engageable with the drive wheel of a carrier spin driver when the carrier is positioned at a location where the stopper is being treated, printed and dried.

6. The printing machine of claim 1, and including an applicator for applying a film of silicone to the stopper after printing.

7. The printing machine of claim 6, wherein the applicator includes an applicator surface supplied with silicone from a silicone supply, which applicator surface applies silicone to the stopper by direct surface-to-surface contact between the applicator surface and the stopper.

8. A method for printing indicia on stoppers of the type having a normally non-ink receptive surface, comprising:

(a) providing a quantity of randomly-oriented stoppers in a bulk hopper;

(b) selecting at least one stopper and orienting it into a predetermined orientation for being fed into a rotatably-mounted carrier of a plurality of carriers mounted on a rotatable carrier assembly;

(c) feeding the at least one stopper into the carrier;

(d) indexing the carrier to a heat-treating position;

(e) heat treating the stopper surface to render the surface at least temporarily receptive to printing ink while rotating the stopper;

(f) indexing the carrier to a printing position;

(g) imprinting an image on the surface of the stopper in the carrier while rotating the stopper;

(h) indexing the carrier to a drying position;

(i) drying the freshly imprinted stopper while rotating the stopper; and (j) repeating steps (a)-(h) with respect to successive stoppers.

9. The method of claim 8, and further comprising the step of moving a moveable holder of the carrier with respect to a stationary holder of the carrier between an open position and an engaged position such that the stopper drops out of the carrier in the open position and the stopper is held between the moveable and stationary holders in the engaged position.

10. The method of claim 8, and including the steps of:

(a) indexing the carrier to a silicone application position; and (b) applying silicone to the surface of the printed stopper.

11. The method of claim 10, wherein the step of applying silicone to the surface of the printed stopper comprises the steps of:

(a) applying one or more metered drops of silicone to the surface of the stopper;

(b) indexing the carrier to a wiping position; and (c) distributing the silicone onto the surface of the stopper by surface-to-surface contact between the stopper and a wiping surface.

12. The method of claim 10, wherein the step of applying silicone to the surface of the printed stopper comprises the step of distributing the silicone onto the surface of the stopper by surface-to-surface contact between the stopper and a wiping surface supplied with silicone thereon.

13. The method of claim 10, wherein the surface supplied with silicone comprises a sponge.

* * * * *

UNITED STATES PATENT AND TRADEMARK OFFICE

CERTIFICATE OF CORRECTION

PATENT NO. : 6,907,822 B2
DATED : June 21, 2005
INVENTOR(S) : Coningsby, Gregg O.

It is certified that error appears in the above-identified patent and that said Letters Patent is hereby corrected as shown below:

Column 11,
Line 6, delete “the and” and insert -- the stopper and --.
Line 15, delete “coaxially mounted” and insert -- coaxially-mounted --.

Signed and Sealed this

Fourteenth Day of March, 2006

JON W. DUDAS
*Director of the United States Patent and Trademark Office*